United States Patent [19]

Kemeny

[11] Patent Number: 4,714,003

[45] Date of Patent: Dec. 22, 1987

[54] ELECTROMAGNETIC LAUNCHER WITH A PASSIVE INDUCTIVE LOOP FOR RAIL ENERGY RETENTION OR DISSIPATION

[75] Inventor: George A. Kemeny, Pittsburgh, Pa.

[73] Assignee: Westinghouse Electric Corp., Pittsburgh, Pa.

[21] Appl. No.: 702,771

[22] Filed: Feb. 19, 1985

[51] Int. Cl.[4] ..... F41F 1/02

[52] U.S. Cl. ..... 89/8; 124/3; 310/12

[58] Field of Search ..... 89/8; 124/3; 310/11-14; 318/135

[56] References Cited

U.S. PATENT DOCUMENTS

| | | | |
|---|---|---|---|
| 4,319,168 | 3/1982 | Kemeny | 89/8 X |
| 4,343,223 | 8/1982 | Hawke et al. | 124/3 X |
| 4,347,463 | 8/1982 | Kemeny et al. | 124/3 X |
| 4,423,662 | 1/1984 | McAllister | 89/8 |
| 4,437,383 | 3/1984 | Deis et al. | 89/8 |
| 4,577,545 | 3/1986 | Kemeny | 124/3 X |

*Primary Examiner*—Deborah L. Kyle
*Assistant Examiner*—John E. Griffiths
*Attorney, Agent, or Firm*—R. P. Lenart

[57] ABSTRACT

An electromagnetic projectile launching system is provided with a passive, conductive loop for energy retention, dissipation or recovery. In a parallel rail launcher, this passive loop is inductively coupled to substantially link magnetic flux produced within the launcher by current flowing in a pair of parallel projectile launching rails. During projectile acceleration, parasitic current flow in the passive inductive loop turn or turns is prevented by a rectifier array. When the projectile exits, post-firing rail inductive energy is inductively and rapidly transferred to the passive inductive loop and is either dissipated there or may be beneficially employed to help accelerate a successive projectile.

17 Claims, 8 Drawing Figures

ELECTROMAGNETIC LAUNCHER WITH A PASSIVE INDUCTIVE LOOP FOR RAIL ENERGY RETENTION OR DISSIPATION

BACKGROUND OF THE INVENTION

This invention relates to electromagnetic projectile launchers and more particularly to such launchers which include structures for recovering inductively stored rail energy or for accelerating projectile rail current decay following the launch of a projectile.

In parallel rail electromagnetic projectile launcher systems, muzzle shunting circuitry has been proposed for the purpose of dissipating inductive energy which remains stored in the rail bore length just after projectile exit. This muzzle shunting circuitry may include a muzzle shunt resistor which is connected across the rails such that most of the post-firing rail inductive energy is dissipated in the resistor rather than in an arc at the muzzle ends of the rails. Dissipating energy in a resistor reduces the fraction of post-firing energy which must be dissipated by the projectile rails and hence reduces rail temperatures, reduces rail cooling requirements or allows more shots to be fired without attaining excessive rail temperatures.

My copending commonly assigned application, Ser. No. 564,050, filed Dec. 21, 1983 and entitled "Electromagnetic Launcher with Improved Rail Energy Recovery or Dissipation" discloses muzzle shunting circuitry which includes conductors which lie parallel to the launcher rails and which are folded toward the breech end of the rails from their attachment points near the muzzle end of the rails. The muzzle shunting loop may be resistive to dissipate the rail inductive energy or may contain switching elements to usefully recover a fraction of that energy. Since the muzzle shunting loop is electrically attached to the launcher rails near the muzzle, premature and parasitic muzzle loop current flow may have to be impeded by a series switching means in launchers where a significant muzzle voltage appears during projectile acceleration, for example, in arc-driven launchers. Application Ser. No. 564,050 includes additional background material and is hereby incorporated by reference.

SUMMARY OF THE INVENTION

The present invention includes a parallel rail electromagnetic projectile launcher having a passive inductive loop for energy retention or dissipation. The loop is passive because it is not metallically connected to either the projectile rails nor to any power supply. The loop is closely inductively coupled to the launcher rails and serves to either dissipate the post-firing rail inductive energy or to help in gainfully utilizing this energy. In either case, the loop serves to reduce or substantially eliminate post-firing muzzle arcing.

An electromagnetic projectile launcher constructed in accordance with the present invention includes a pair of conductive rails, a source of electric current and means for switching current from the current source to the rails. A plasma or sliding metallic armature serves as means for conducting current between the rails and for propelling a projectile along the rails. A passive conductive loop is insulated from the rails and inductively coupled to the rails to link magnetic flux produced between the rails by current flowing in the rails. This loop is used to dissipate post-firing rail inductive energy or to help in gainfully utilizing this energy. Means for controlling current flow in the conductive loop is provided to minimize any detrimental effect that the passive loop might have on projectile acceleration. In the preferred embodiments, this means for controlling acts to prevent current flow in the passive loop during projectile acceleration.

DESCRIPTION OF THE PREFERRED EMBODIMENTS

Figure 1:
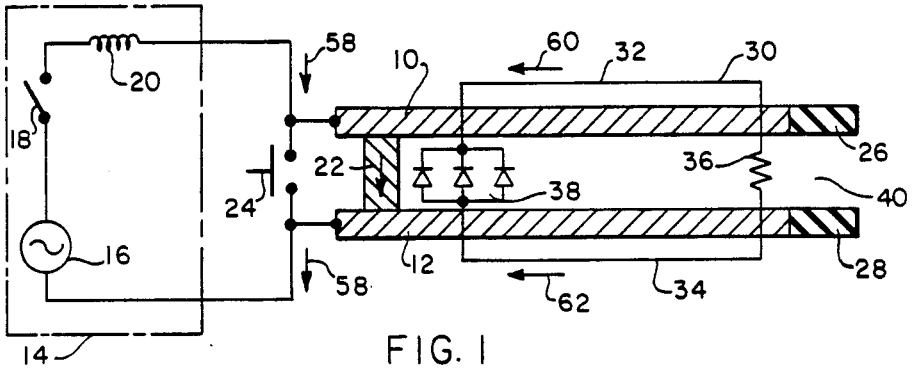
FIG. 1 is a schematic diagram of an electromagnetic projectile launcher constructed in accordance with one embodiment of the present invention.

Referring to the drawings, FIG. 1 is a schematic diagram of an electromagnetic projectile launching system constructed in accordance with one embodiment of the present invention. A pair of generally parallel conductive projectile launching rails 10 and 12 are connected to a source of high current 14 which includes, for example, the series connection of a generator 16, switch 18, and inductive energy storage device 20. Of course, other known current sources can be used in the launcher systems of this invention. An arc or metallic conductive armature 22 is located between the projectile launching rails and serves as means for conducting current between the rails and for propelling a projectile along the rails. A firing switch 24 is connected to the breech ends of the projectile launching rails 10 and 12. Insulating or higher resistance rail segments 26 and 28 may be provided adjacent to the muzzle ends of the projectile launching rails 10 and 12, respectively, to improve the rate of current transfer into a passive conductive loop 30.

The passive inductive loop 30 includes a series connection of conductors 32 and 34, optional resistor or portion of increased impedance 36, and rectifying diode array 38. Conductors 32 and 34 lie closely adjacent to and parallel to the projectile launching rails 10 and 12 so that substantially all of the magnetic flux within bore 40 caused by current flowing in the projectile launching rails is linked by the passive inductive loop turn. It should be understood that even through only one passive inductive loop turn is shown in FIG. 1, there may actually be a number of such individual turns, for example, two parallel turns, one on each side of the rails, or a number of such turns which are connected in series.

Figure 2:
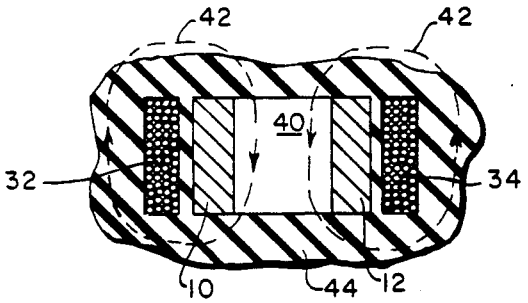
FIGS. 2 and 3 are cross sections of alternative embodiments of the bore portion of launchers of the present invention.

FIG. 2 is a cross-section of the bore portion of a launcher constructed in accordance with the schematic diagram of FIG. 1. In this Figure, the passive inductive loop conductors 32 and 34 can be seen to include high current cabling composed of a multitude of small transposed conductors. If the loop serves only to dissipate the post-firing rail inductive energy in order to reduce muzzle arcing and reduce projectile rail heating by the post-firing current, then the loop can be wound with resistive cabling in order to dissipate energy or an energy dissipating resistor, such as 36 in FIG. 1, can be connected in series with the loop which can then be composed of low resistance cabling. The passive loop conductors and projectile launching rails of FIG. 2 are shown to be supported by an insulating support structure 44. Substantially all of the flux 42 produced by current flowing in the projectile launching rails is linked by the passive loop.

Figure 3:
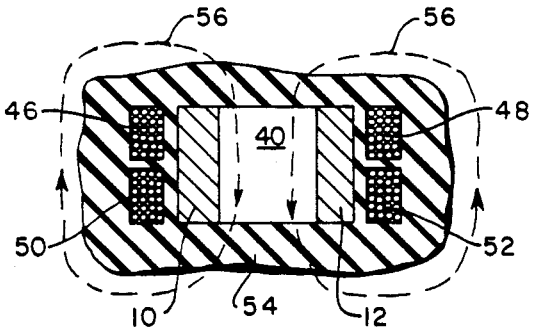

FIG. 3 is a cross-section of an alternative embodiment of the bore portion of a launcher constructed in accordance with this invention. This embodiment includes two passive inductive loops, with the first loop comprising conductors 46 and 48, and the second loop comprising conductors 50 and 52. These passive loop conductors are mounted adjacent to and parallel to projectile launching rails 10 and 12 in support structures 54 so as to link substantially all of the magnetic flux 56 passing through bore 40 and caused by current flowing in projectile launching rails 10 and 12.

In order to explain the operation of the passive inductive loop for energy reduction, it is assumed for simplicity that in FIG. 1, all projectile rail magnetic flux in the projectile rail length extending between the diode array 38 and the resistor 36 is linked by the passive inductive loop 30. When firing switch 24 opens, current flows in the direction indicated by arrows 58 in FIG. 1 and the armature 22 is accelerated toward the muzzle end of the launching rails. While the armature travels along the rails which are paralleled by the passive inductive loop conductors, the increasing amount of flux caused by current flow in the projectile launching rails, induces in the passive loop, a voltage having a significant component, $e_A$, at a given projectile location in the bore that is equal to:

$$e_A = \frac{Nd\phi}{dt} = \frac{d\phi}{dt} = \frac{d}{dt}(xL'I) = IL'\frac{dx}{dt} = IL'v; \quad (1)$$

where L' is the inductance gradient, x is the projectile location in the bore length, N is the number of passive loop turns, Φ is the linked flux and I is the instantaneous current when the armature is at that bore position. While the projectile is travelling from a point adjacent to the rectifier array 38 to a point adjacent to the resistor 36, the induced voltage IL'v will be the predominant voltage in the passive inductive loop circuit and this voltage is directed to produce current flow in the direction illustrated by arrow 60. However, such parasitic current flow is and must be prevented by diode array 38 since there would otherwise be a drastic accelerating force loss. Thus, during projectile acceleration, parasitic loop current flow in the undesired direction is prevented by the diode array and local eddy current losses in the passive inductive loop cabling are minimized by using small individual strands of transposed wires for the loop cabling.

As soon as the bore length between the diode array and the resistor is filled with magnetic flux, that is, when the armature is at or just past the resistor 36, armature velocity ceases to induce voltage in the passive inductive loop and the predominant induced voltage, $e_M$, becomes:

$$e_M = N\frac{d\phi}{dt} = \frac{d}{dt}(XL'I) = XL'\frac{dI}{dt}; \quad (2)$$

where X is now the length of the flux filled loop which no longer changes, and dI/dt is the rate of change of current. With dI/dt negative, and accelerating current will be decreasing at projectile exit, $e_M$ now causes current flow in the passive inductive loop turn in the desired and allowed direction illustrated by arrow 62. In essence, the current now flows in the passive inductive loop in a direction which impedes flux collapse. To more rapidly inject current into the passive inductive loop, it is desirable to maximize the absolute value of dI/dt and this is easily done by, for example, using resistive rail portions 26 and 28 in the vicinity of or just past the resistor 36. Additionally, any voltage drop in the projectile rail loop will hasten current transfer into the passive inductive loop. For example, both the back EMF if the armature is still moving, and the muzzle arc voltage as the armature exits the projectile launching rails, will accelerate current transfer into the passive inductive loop cabling.

In order to cause rapid injection of current into the passive inductive loop cabling and to prevent additional and unrequired energy wastage, the firing switch 24 should be closed when the armature is in the vicinity of the muzzle. This switch closure prevents additional energy flow from the power supply to the projectile launching rails. The launching system illustrated by the schematic diagram of FIG. 4 includes a switch control mechanism 64 which serves to reclose firing switch 24 in response to an electrical signal generated by a projectile sensing device 66. By closing switch 24 at the proper time and by deliberately adding impedance or increasing the voltage drop toward the muzzle, the post-firing inductively stored rail energy rapidly induces current flow in the passive inductive loop and the rail flux is thereafter maintained by current flow in this passive turn. If it is only desired to waste this energy, a series resistor, such as resistor 36 in FIG. 1 in the passive inductive loop or resistive cabling can provide the desired rate of energy loss and hence current decay.

Figure 4:
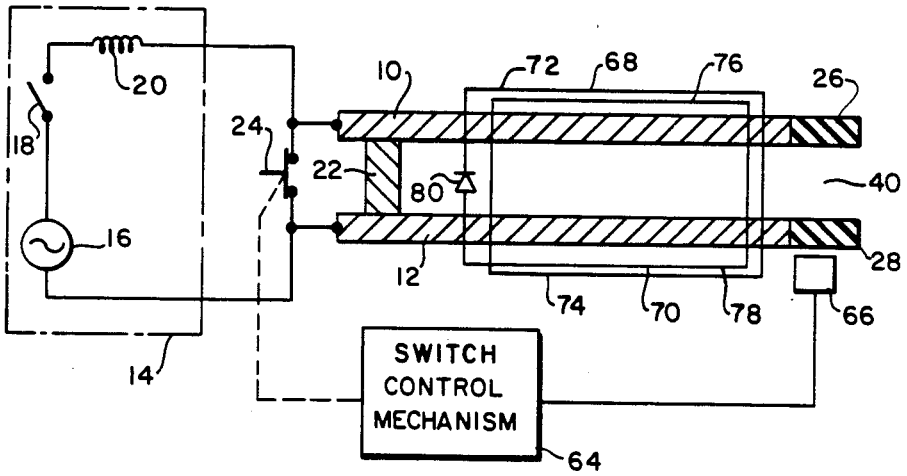
FIG. 4 is a schematic diagram of an alternative embodiment of the present invention which includes a multiple turn passive inductive loop.

In addition to a switch control mechanism, FIG. 4 also illustrates the use of a multiple turn passive inductive loop. This loop consists of two turns 68 and 70 which are electrically connected in series with each other and in series with a diode, or diode array, 80. Turn 68 includes conductors 72 and 74 while turn 70 includes conductors 76 and 78. These conductors are positioned adjacent to and parallel to the projectile launching rails in order to link magnetic flux produced within bore 40 by current flowing in the projectile launching rails.

Figure 8:
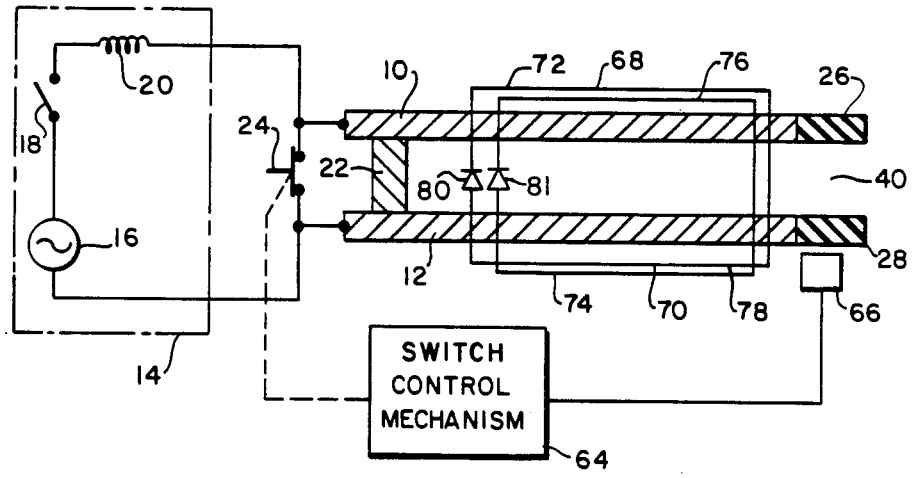

FIG. 8 illustrates the use of two parallel passive inductive loops. In FIG. 8, turns 68 and 70 form separate loops and diodes 80 and 81 serve as means for controlling current flow in the loops.

In order to maximize the fraction of total post-firing rail inductive energy which is to be first transferred to and then initially stored in the passive inductive loop turn, that turn or turns should extend over substantially the complete projectile bore length so as to link, at projectile exit, as much of the projectile bore flux as possible. During the current transfer into this turn, its resistance should be as low as possible to increase the rate of current injection into the turn. It is estimated that for a reasonably large bore size, for example at least 3×3 inches, 80% to 90% of the post-firing rail inductive energy is transferable to a suitably configured passive inductive loop turn.

Figure 5:
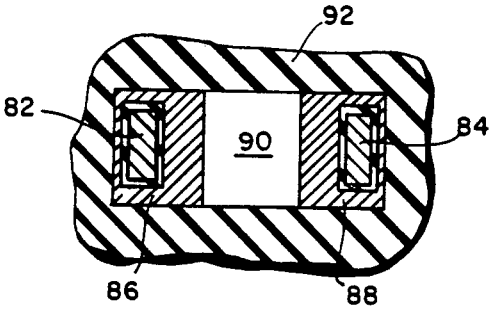
FIG. 5 is a cross section of the bore portion of another embodiment of the present invention.

FIG. 5 is a cross section of the bore portion of another embodiment of the present invention, in which conductors 82 and 84 of the insulated conductive loop are shown to be substantially concentric with a pair of generally parallel projectile launching rails 86 and 88 which line bore 90. It should be understood that although the conductive loop conductors 82 and 84 in FIG. 5 are shown to be completely encased within their associated projectile rails, openings must be provided, preferably near the breech and muzzle ends, in each projectile launching rail so that conductors 82 and 84 can be electrically connected in series with each other. The concentric design of FIG. 5 ensures that the conductive loop links substantially all of the magnetic flux produced within the bore 90 by current flowing in rails 86 and 88.

Figure 6:
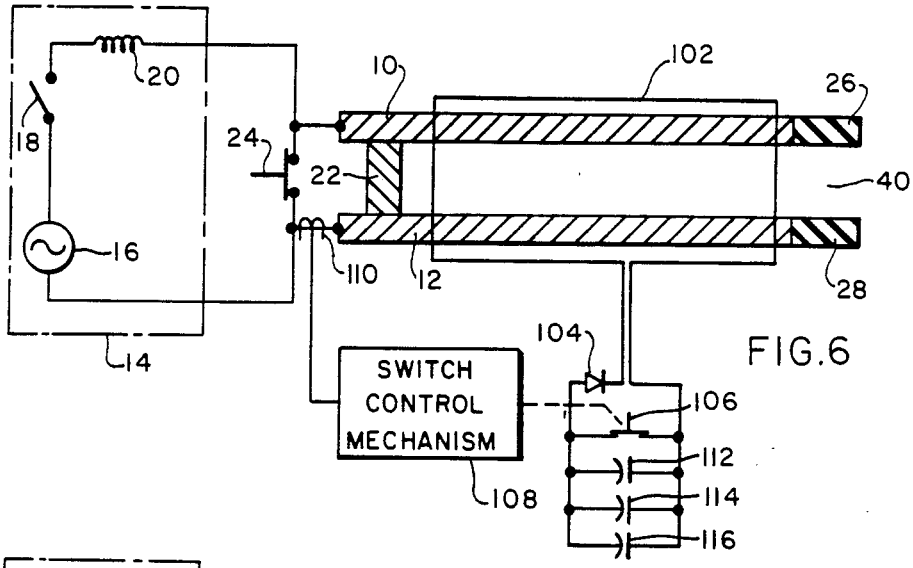
FIG. 6 is a schematic diagram of another alternative embodiment of the present invention in which the energy transferred to the passive inductive loop is stored in a capacitor array.

If it is desired to only dissipate the post-firing rail energy in a passive inductive loop system, then the passive inductive loop has the desirable features of reducing projectile rail temperature rise and suppressing muzzle arcs without premature or parasitic current flow. If it is desired to recover or usefully utilize the energy stored in the passive inductive loop turn, then the passive inductive loop cabling should be of as low an impedance as is economically feasible and cryogenic conductor cooling should be considered. FIG. 6 is a schematic diagram of an alternative embodiment of the present invention in which the energy in the passive inductive loop is stored in a capacitor array. In this embodiment, a passive inductive loop 102 is connected in series with a rectifier 104 and a switch 106. Switch 106 must be opened only after cessation of all current flow in the projectile launching rails and hence when the projectile rail circuit is opened at the muzzle. Otherwise, the opening of switch 106 could cause reinjection of current back into the still closed projectile rail loop. In order to control the switch function, switch control mechanism 108 is connected to a current transformer 110 and serves to only open switch 106 after current ceases flowing in the projectile launching rails. Once the projectile loop is opened and hence has a very high impedance, the opening of switch 106 will produce a switching voltage across the switch which can inject current or energy into suitable system components such as capacitors 112, 114 and 116 for energy storage for suitable re-use. A capacitor energy storage array allows long-time energy storage and this energy could thereafter be utilized to help propel a successive projectile fired at a later time in the same or another bore.

The most direct use of the passive conductive loop current is the augmentation of the accelerating force on a second projectile fired in the same bore as the preceding projectile by using the magnetic field produced by current flowing in the conductive loop. The time constant of a suitably designed and preferably cryogenically cooled passive loop will be many tens to many hundreds of milliseconds. Therefore, if successive shots are fired at intervals of a few milliseconds or a few tens of milliseconds, most of the energy stored in the passive loop turn will be directly utilized to help accelerate the successive projectile. An examination of the launcher of FIG. 1 reveals that as soon as the armature enters the volume in which the passive loop turn maintains magnetic flux, that flux is in the proper direction to augment projectile rail fux and thus to augment the projectile accelerating force. As the projectile is accelerated, the passive loop stored energy will be quite rapidly drained and usefully utilized in the projectile acceleration. When the passive loop energy storage is depleted, the passive loop current goes to zero, current reversal is prevented by the rectifier array 38, and the passive loop turn becomes inactive until it is again recharged with projectile rail post-firing inductive energy when the projectile exits. This type of operation is particularly attractive as it requires no additional circuit components beyond the passive loop conductors 32 and 34 and the diode array 38 of FIG. 1.

Figure 7:
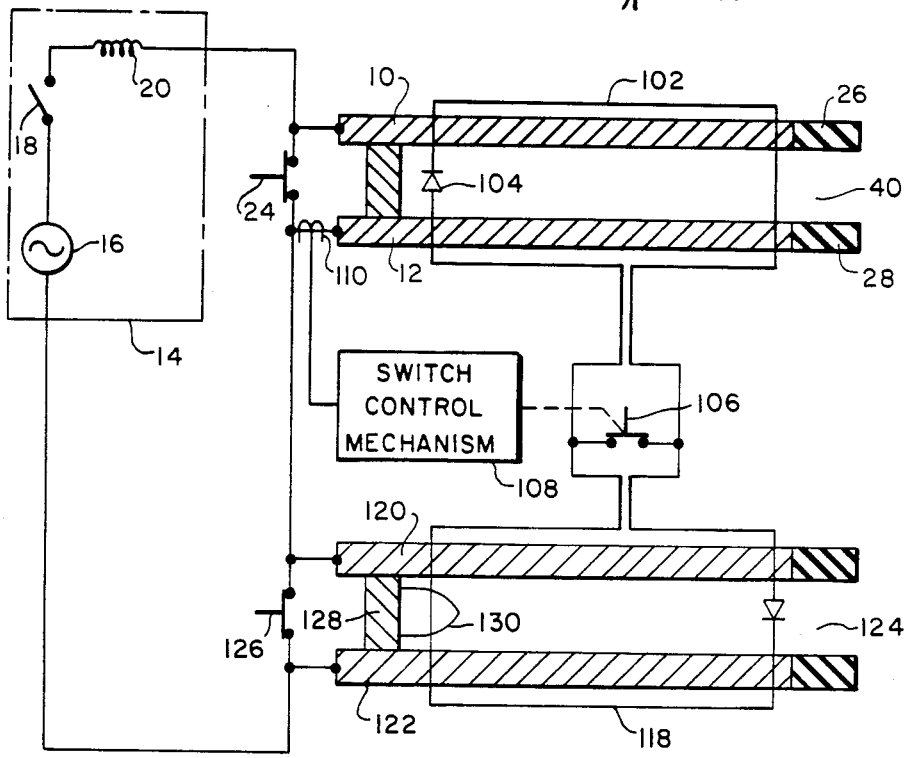
FIG. 7 is a schematic diagram of another alternative embodiment of the present invention in which the current in the passive inductive loop is used to augment the magnetic field in a second launcher bore and FIG. 8 is a schematic diagram of another alternative embodiment of the present invention which includes two passive inductive loops.

FIG. 7 is a schematic diagram of a multiple bore projectile launcher in which the passive loop inductive energy of a first bore is used to help propel a successive projectile fired in a second bore. The launcher of FIG. 7 is similar to the launcher of FIG. 6 except that the capacitor array of FIG. 6 has been replaced by a conductive loop 118. This second loop is positioned adjacent to a pair of projectile launching rails 120 and 122 which line a second bore 124. A second firing switch 126 is connected across the breech ends of the second pair of projectile launching rails and would be opened, for example, tens of milliseconds after the launch of a projectile in bore 40. Switch 106 would be opened before switch 126 in order to augment the magnetic field produced by current flowing in the projectile launching rails 120 and 122 and the armature 128 within bore 124. Therefore, in the system of FIG. 7, all of the inductive energy stored in the two series-connected passive inductive loop windings would be completely drained, current would stop flowing at a current zero, and the two passive inductive loops should then be separated again by closing switch 106 before the exit of the second projectile 130. Only the passive inductive loop which is subjected to projectile flux will then be recharged with current.

In the preferred embodiments which utilized a single turn passive inductive loop, the loop current would be almost equal to the projectile rail muzzle current. Therefore, the rectifying diode array will require many elements in parallel. Alternatively, a passive inductive loop as shown in FIG. 4 can be composed of a number of series-connected turns. If there are N turns, the passive inductive loop current will now be about 1/N times the projectile rail muzzle current, which favorably reduces the number of parallel diodes required by a factor of about N.

Although the present invention has been disclosed in terms of what are at present to be believed its preferred embodiments, it will be apparent to those skilled in the art that various changes may be made without departing from the scope of the invention. It is, therefore, intended that the appended claims cover all such changes.

I claim:

1. An electromagnetic projectile launcher comprising:

a pair of conductive rails, having a breech end and a muzzle end;

a source of electric current;

means for switching current from said current source to said rails;

means for conducting current between said rails and for propelling a projectile along said rails;

means for electrically insulating;

a first conductive loop which is electrically insulated by said insulating means from said rails and inductively coupled to said rails to link magnetic flux produced between said rails by current flowing through said rails; and means for controlling current flow in said conductive loop.

2. An electromagnetic projectile launcher as recited in claim 1, wherein said means for controlling current flow comprises:

circuit elements electrically connected in series with said conductive loop to prevent current flow in said loop during acceleration of said projectile.

3. An electromagnetic projectile launcher as recited in claim 1, wherein said first conductive loop is positioned substantially within said rails to link substantially all of the magnetic flux produced between said rails by current flowing through said rails.

4. An electromagnetic projectile launcher as recited in claim 1 wherein said first conductive loop includes conductors which are substantially coaxial with each of said conductive rails.

5. An electromagnetic projectile launcher as recited in claim 1, wherein said conductive loop comprises:

a plurality of transposed conductors.

6. An electromagnetic projectile launcher as recited in claim 1, further comprising:

means for providing ohmic resistance electrically connected in series with said conductive loop.

7. An electromagnetic projectile launcher as recited in claim 1, wherein said means for switching current comprises:

a firing switch connected between the breech ends of said rails; and means for closing said firing switch when said projectile reaches a predetermined position.

8. An electromagnetic projectile launcher as recited in claim 1, wherein said conductive rails each include a portion of increased electrical impedance located adjacent to the muzzle end.

9. An electromagnetic projectile launcher as recited in claim 1, further comprising:

a second conductive loop electrically connected in series with said first conductive loop and inductively coupled to said rails to link magnetic flux produced between said rails by current flowing through said rails.

10. An electromagnetic projectile launcher as recited in claim 1, further comprising:

a second conductive loop electrically insulated from said first conductive loop and inductively coupled to said rails to link magnetic flux produced between said rails by current flowing through said rails; and means for controlling current flow in said second conductive loop.

11. An electromagnetic projectile launcher as recited in claim 1, further comprising:

a second pair of conductive rails;

means for switching current from said current source to said second pair of rails;

means for conducting current between said second pair of rails and for propelling a second projectile along said second pair of rails;

a controllable switch electrically connected in series with said first conductive loop;

a second conductive loop electrically connected across said controllable switch and inductively coupled to said second pair of rails to link magnetic flux produced between said second pair of rails by current flowing through said second pair of rails; and means for opening said controllable switch when current flow in said first pair of conductive rails ceases following the acceleration of said first projectile.

12. An electromagnetic projectile launcher as recited in claim 1, further comprising:

an electrical energy storage means connectable into said conductive loop.

13. An electromagnetic projectile launcher as recited in claim 12, wherein said means for shorting said energy storage device comprises:

a switch electrically connected across said energy storage device; and means for opening said switch when the current flow in said rails ceases following a launch of said projectile.

14. An electromagnetic projectile launcher as recited in claim 12, further comprising:

means for electrically shorting said energy storage device.

15. An electromagnetic projectile launcher as recited in claim 14, wherein said electrical energy storage means comprises a capacitor.

16. A method of inhibiting arcing at muzzle ends of a pair of projectile launching rails of a parallel rail electromagnetic projectile launcher following the launch of a projectile, said method comprising the steps of:

placing a conductive loop adjacent to and electrically insulated from said pair of projectile launching rails to link magnetic flux produced by current flowing in said rails; and controlling current in said conductive loop to prevent induced current flow during projectile acceleration and to permit induced current flow after projectile acceleration.

17. A method of recovering energy stored in a pair of projectile launching rails of a parallel rail electromagnetic projectile launcher following the launch of a projectile, said method comprising the steps of:

placing a conductive loop adjacent to and electrically insulated from said pair of projectile launching rails to link magnetic flux produced by current flowing in said rails;

controlling current in said conductive loop to prevent induced current flow during projectile acceleration and to permit induced current flow after projectile acceleration; and connecting an energy storage means into said conductive loop.

* * * * *